US008454225B2

(12) United States Patent
Salzmann et al.

(10) Patent No.: US 8,454,225 B2
(45) Date of Patent: Jun. 4, 2013

(54) DEVICE FOR ELECTROMECHANICAL WATCH FOR DETERMINING THE MOMENT AT WHICH AND THE DIRECTION IN WHICH A TIME INDICATION HAS TO BE CORRECTED

(75) Inventors: Christian Salzmann, Safnern (CH); Laurent Kaelin, Sonvilier (CH)

(73) Assignee: ETA SA Manufacturing Horlogère Suisse, Grenchen (CH)

( * ) Notice: Subject to any disclaimer, the term of this patent is extended or adjusted under 35 U.S.C. 154(b) by 162 days.

(21) Appl. No.: 13/024,703

(22) Filed: Feb. 10, 2011

(65) Prior Publication Data

US 2011/0205855 A1 Aug. 25, 2011

(30) Foreign Application Priority Data

Feb. 23, 2010 (EP) ..... 10154411

(51) Int. Cl.
*G04B 18/00* (2006.01)
*G04B 19/20* (2006.01)

(52) U.S. Cl.
USPC ..... 368/185; 368/37

(58) Field of Classification Search
USPC ..... 368/37, 185, 164
See application file for complete search history.

(56) References Cited

U.S. PATENT DOCUMENTS 2,806,908 A * 9/1957 Van Horn et al. ..... 200/19.01
2,954,663 A * 10/1960 Biemiller et al. ..... 368/162
3,643,421 A * 2/1972 Herr et al. ..... 368/67
3,874,162 A * 4/1975 Boxberger et al. ..... 368/156
3,914,951 A * 10/1975 Heidorn ..... 62/126
5,734,626 A 3/1998 Eckstein
7,027,361 B2 * 4/2006 Burkhardt et al. ..... 368/37
2002/0060953 A1 5/2002 Farine et al.
2005/0002278 A1 1/2005 Dittrich
2006/0109747 A1 5/2006 Ihashi
2010/0142331 A1 * 6/2010 Kimura et al. ..... 368/187

FOREIGN PATENT DOCUMENTS

EP 0 936 512 A2 8/1999

OTHER PUBLICATIONS

European Search Report for EP 10 15 4411 dated Jun. 21, 2010.

* cited by examiner

*Primary Examiner* — Sean Kayes
(74) *Attorney, Agent, or Firm* — Sughrue Mion, PLLC

(57) ABSTRACT

Device for electromechanical watch (1) allowing an electronic control circuit of the watch (1) movement to determine the moment at which and the direction in which an indication showing a magnitude of time has to be corrected, said device including a wheel (68), which is driven by the watch (1) movement and carries means (70, 72) for actuating first and second detection means (46*a*, 46*b*) connected to the electronic control circuit, said electronic control circuit deducing, from the moment at which and the order in which the first and second detection means (46*a*, 46*b*) are actuated by the means actuating the wheel (68) driven by the watch (1) movement, the direction in which the wheel (68) is being driven by the movement at the moment when the magnitude of time has to be respectively incremented or decremented.

17 Claims, 22 Drawing Sheets

DEVICE FOR ELECTROMECHANICAL WATCH FOR DETERMINING THE MOMENT AT WHICH AND THE DIRECTION IN WHICH A TIME INDICATION HAS TO BE CORRECTED

This application claims priority from European Patent Application No. 10154411.2 filed 23 Feb. 2010, the entire disclosure of which is incorporated herein by reference.

The present invention concerns a device for an electromechanical watch for determining the moment at which and the direction in which a time indication has to be corrected. More specifically, the present invention concerns a device for an electromechanical watch allowing an electronic control circuit of the watch movement to determine the direction of rotation of an indicator showing a magnitude of time, driven by the watch movement, and the moment when the magnitude of time has to be respectively incremented or decremented.

An electromechanical watch is a watch whose indicators are driven by a single motor or by several separate motors. An example of this type of electromechanical watch is shown schematically in FIG. 1, annexed to this patent application. Designated as a whole by the general reference number 1, this electromechanical watch is the type with a retrograde perpetual calendar. It includes a first centre hand display 2, a second hand display 4 at 6 o'clock, a third hand display 6 at 2 o'clock and a fourth hand display 8 at 10 o'clock.

The first hand display 2 includes, in a conventional manner, an hour hand 2*a* and a minute hand 2*b* which move above a dial 10. The first hand display 2 is completed by a date hand 2*c* which moves backwards along an index in an arc of a circle 12 which bears the date indications from "1" to "31". The second hand display 4 includes a small seconds hand 4*a*. The third hand display 6 includes a hand 6*a* indicating the days of the week which moves backwards along an index in an arc of a circle 14, on which the days of the week from Monday to Sunday are marked. The fourth hand display 8 includes an hand 8*a* indicating the months of the year which moves backwards along an index in an arc of a circle 16 on which the months of the year are marked. It will be noted that the current year is indicated when the date of watch 1 is set by means of date hand 2*c* which is moved opposite one of the figures "1", "2", "3" or "4" of sector 12 depending upon whether the year during which the date of watch 1 is set is the first, second or third year preceding a leap year which is represented by the figure "4".

The retrograde perpetual calendar watch 1, shown in FIG. 1, is completed by a stem 18 which can occupy a neutral position T1, a first pulled out position T2 and a second pulled out position T3, and two correctors 20 and 22. This electromechanical watch is also driven by four distinct motors. A first motor drives the first hand display 2, namely hour hand 2*a* and minute hand 2*b*, and small seconds hand 4*a* of the second hand display 4. A second motor drives the date hand 2*c*, a third motor drives day of the week indicator hand 6*a* and a fourth and final motor drives month of the year indicator hand 8*a*. These four motors are powered by a battery.

The electromechanical watch 1 briefly described above can be handled in four distinct ways during the assembly and daily use thereof. After watch 1 has been assembled or when the battery is changed, the hands are set at their original position. In other words, the position of all the hands of watch 1 is reset. The second manipulation concerns setting the time of watch 1 which is achieved either during assembly of watch 1, or when the battery is changed. The third manipulation concerns setting the date of watch 1 which must be carried out when the battery is inserted or changed. Finally, the fourth operation relates to a change of time zone.

The operation of resetting the position of the hands allows these hands to be returned to reference positions so that the electronic control circuits of watch 1 can store these reference positions and calculate all of the subsequent movements of the hands from said positions. Date indicator hand 2*c*, day of the week indicator hand 6*a* and month of the year indicator 8*a* are reset to their original position. In other words, date indicator hand 2*c* is moved to the first day of the month, day of the week indicator hand 6*a* is moved to Monday and month of the year indicator hand 8*a* is moved to January.

Hour and minute hands 2*a* and 2*b* are set to the time mechanically with stem 18 in pulled out position T3. The hour and minute are adjusted by rotating stem 18. When the time is set, the AM and PM positions of hands 2*a*, 2*b* should be respected. During this operation of setting the time of watch 1, date indicator hand 2*c*, day of the week hand 6*a* and month of the year hand 8*a* indicate a given date.

The operation of setting the date of watch 1 is performed electrically by means of stem 18 in pulled out position T3 and the two correctors 20 and 22. The order of selection of the hands starts with the year (hand 2*c*) and continues with the month (hand 8*a*), the date (hand 2*c*) and the day (hand 6*a*) and finally returns to the year. An application of pressure on corrector 22 moves the selected indicator hand one step forwards in the positive direction. An additional application of pressure on corrector 20 confirms the selected value and causes the next hand to move.

Finally, the time zone change operation is performed in the same way as the time-setting operation of the watch. However, this latter operation raises a problem. Indeed, when the time zone is being changed, it must be possible to detect when the time changes to midnight in order to synchronize the date change with the change of day. Moreover, the direction of the time correction also needs to be known when there is a time zone change since this change affects not only the date indication but may also affect the day of the week indication, and the month and year indication. In other words, the whole of the kinematic chain, which will be termed "digital" in that it is formed of motors that are mutually independent and the operation thereof is managed by the electronic control circuits of the watch, is affected by the time zone change.

It is an object of the present invention to overcome this problem by providing a device for an electromechanical watch that can determine the moment at which and the direction in which a time indication has to be corrected.

This invention therefore concerns a device for an electromechanical device allowing an electronic control circuit of the watch movement to determine the moment at which and the direction in which an indication showing a magnitude of time has to be corrected, said device including a wheel which is driven by the watch movement and carries means for actuating first and second detection means connected to the electronic control circuit, the electronic control circuit deducing, from the moment at which and the order in which the first and second detection means are actuated by the actuating means of the wheel driven by the watch movement, the direction in which the wheel is being driven by the movement and the moment when the magnitude of time has to be respectively incremented or decremented.

Owing to these features, this invention provides a device which enables an electronic control circuit of an electromechanical watch to detect the change in time to midnight in order to synchronize the change in a time related parameter, like the date indication, with the change of day. Moreover, since the electronic control circuit receives information as to the order in which the first and second detection means have been actuated by the actuating means of the wheel driven by the watch movement, the electronic control circuit is also aware of the direction of the time change. It can then synchronize the entire electronic kinematic chain which connects it to mutually independent motors that each drive a counter which can be affected by the time change.

Other features and advantages of the present invention will appear more clearly from the following detailed description of one embodiment of the device according to the invention, this example being given solely by way of non-limiting illustration with reference to the annexed drawing, in which:

FIG. 2I is a similar view to that of FIG. 2H showing that an actuating wheel is engaged on the earthing stud after the washer;

The present invention proceeds from the general inventive idea that consists in fitting an electromechanical watch, which includes mutually independent motors each driving an indicator showing a magnitude of time, with a device connected to the electronic control circuit of the watch and capable of determining at what moment and in which direction the time changes to midnight. With this information available, the electronic control circuit of the watch is able to synchronize all of the motors and operate the forward or backward movement of the indicators affected by the time change.

The structure of the detection device according to the invention will first of all be examined. The operation of this detection device will be examined in a second part.

Figure 1:
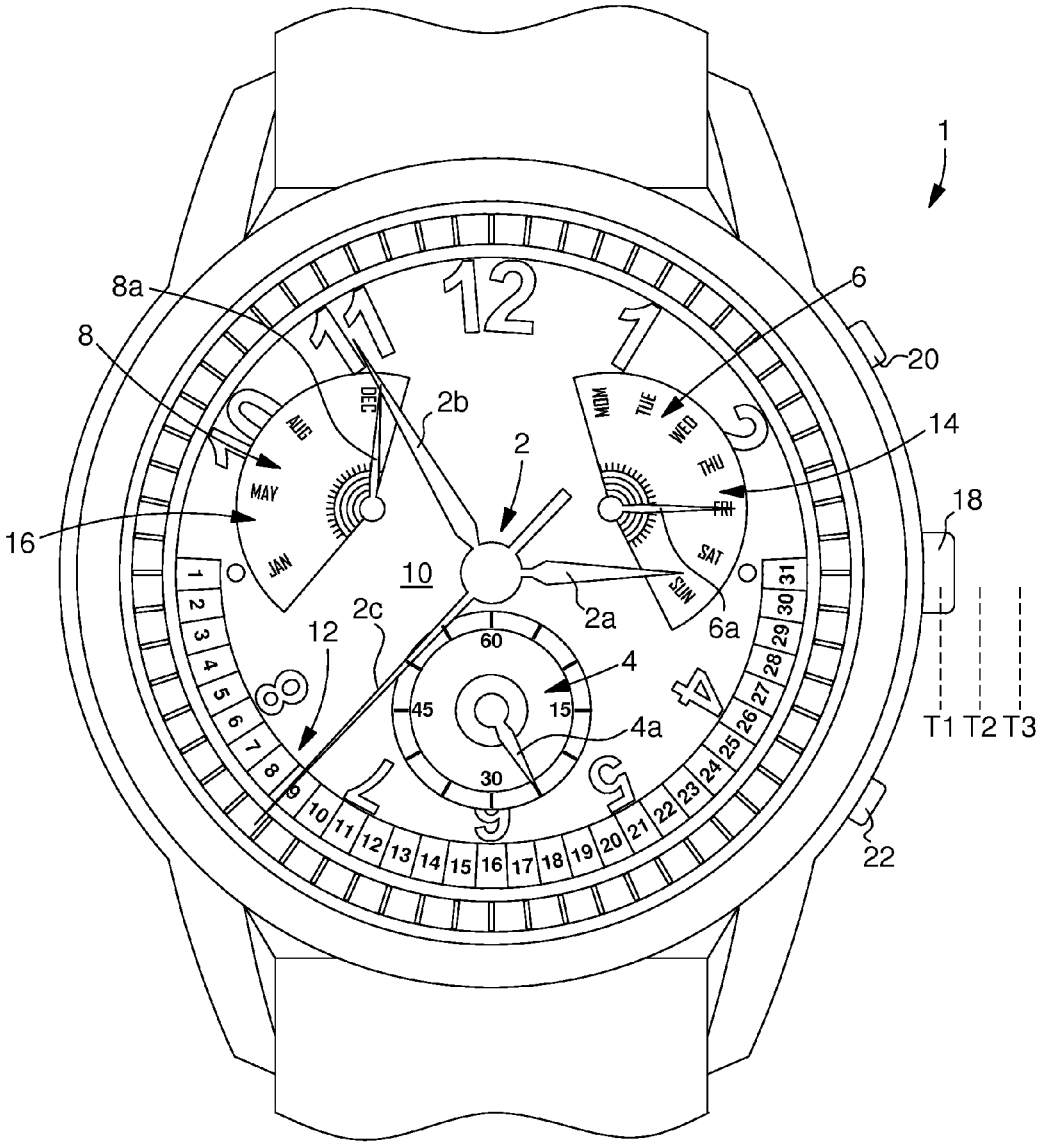
FIG. 1 is a plan view of an electromechanical watch with the retrograde perpetual calendar fitted with the device according to the invention.
Figure 2A:
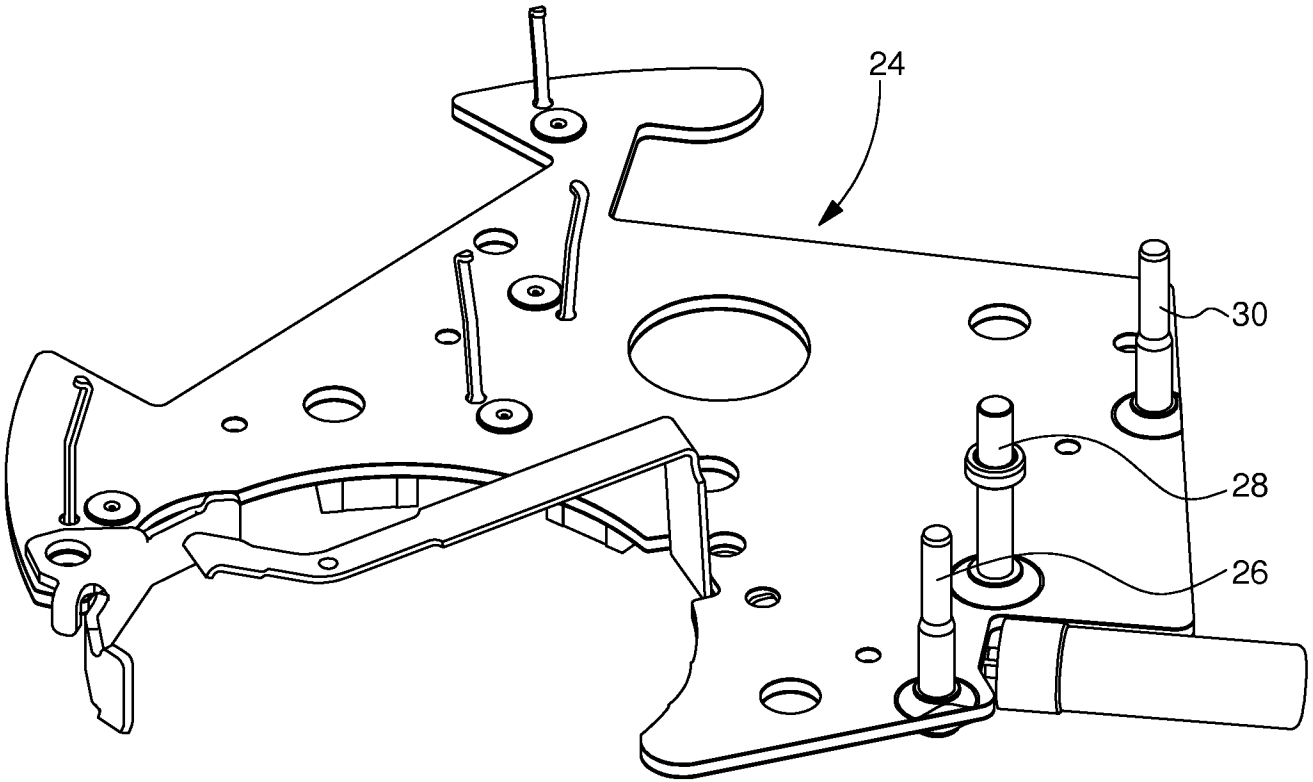
FIG. 2A is a perspective view of an electronic module which carries three studs standing perpendicularly to the surface of the electronic module.
Figure 2B:
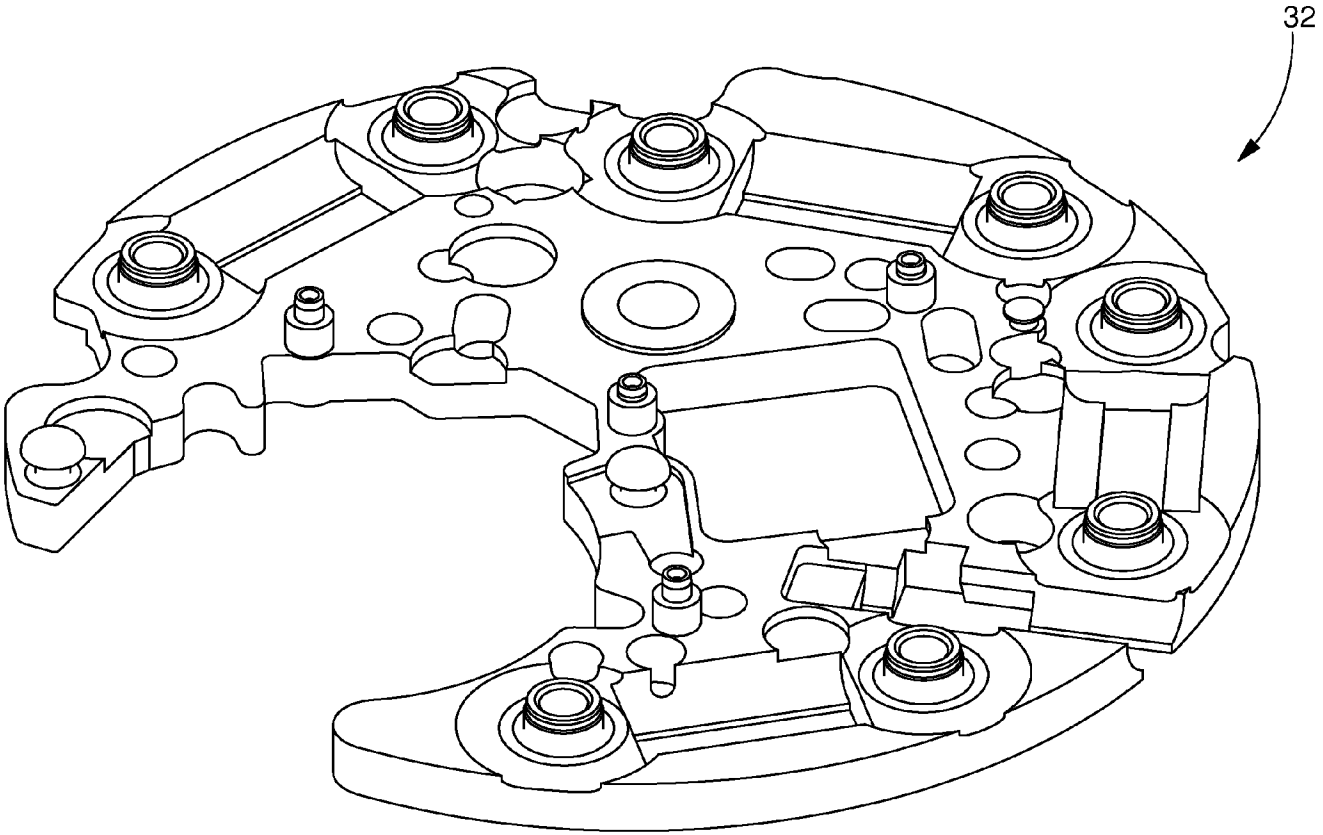
FIG. 2B is a perspective view of an additional plate on which the electronic module of FIG. 2A is intended to assembled.
Figure 2C:
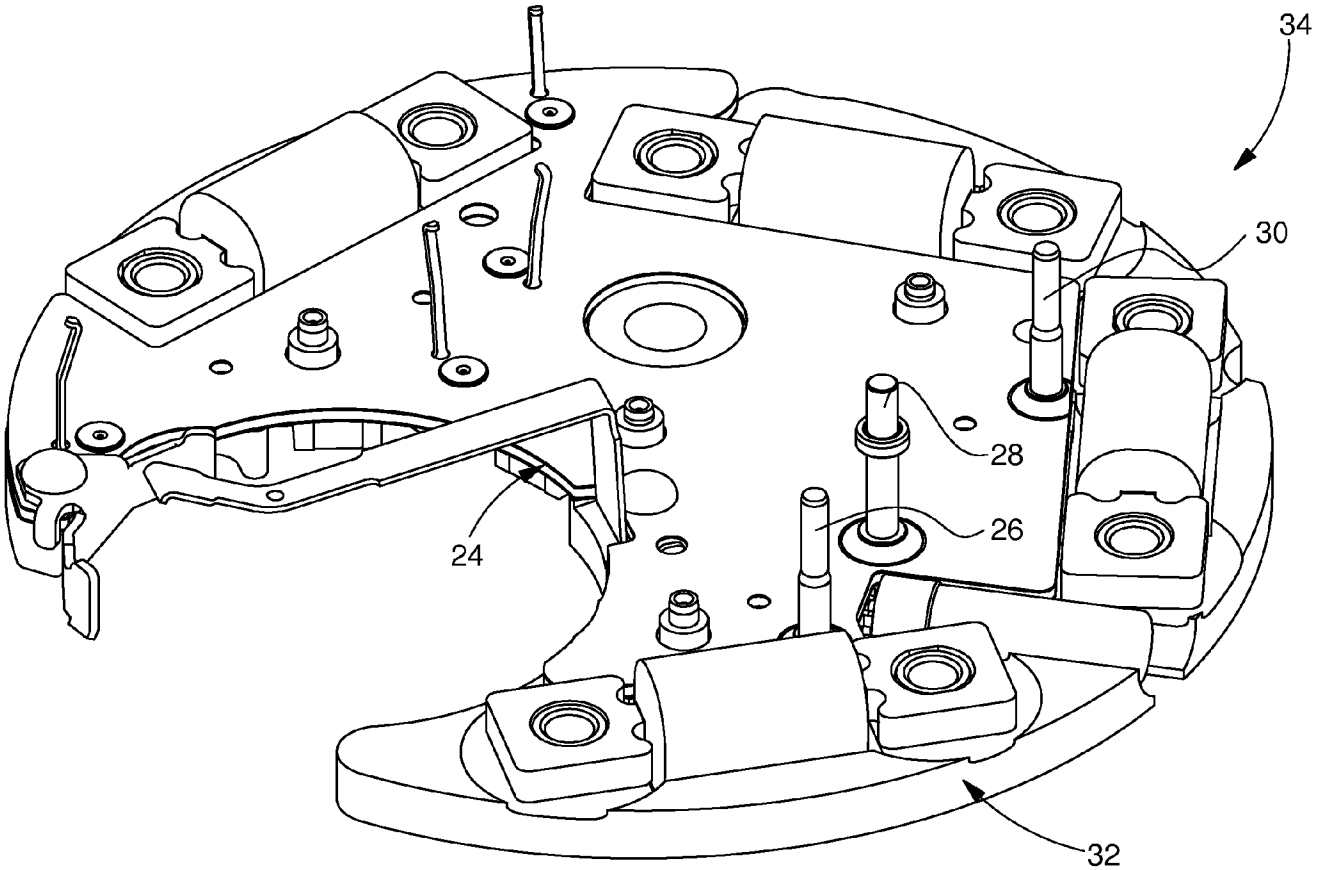
FIG. 2C illustrates an assembled electronic unit associating the electronic module of FIG. 2A and the additional plate illustrated in FIG. 2B.
Figure 2D:
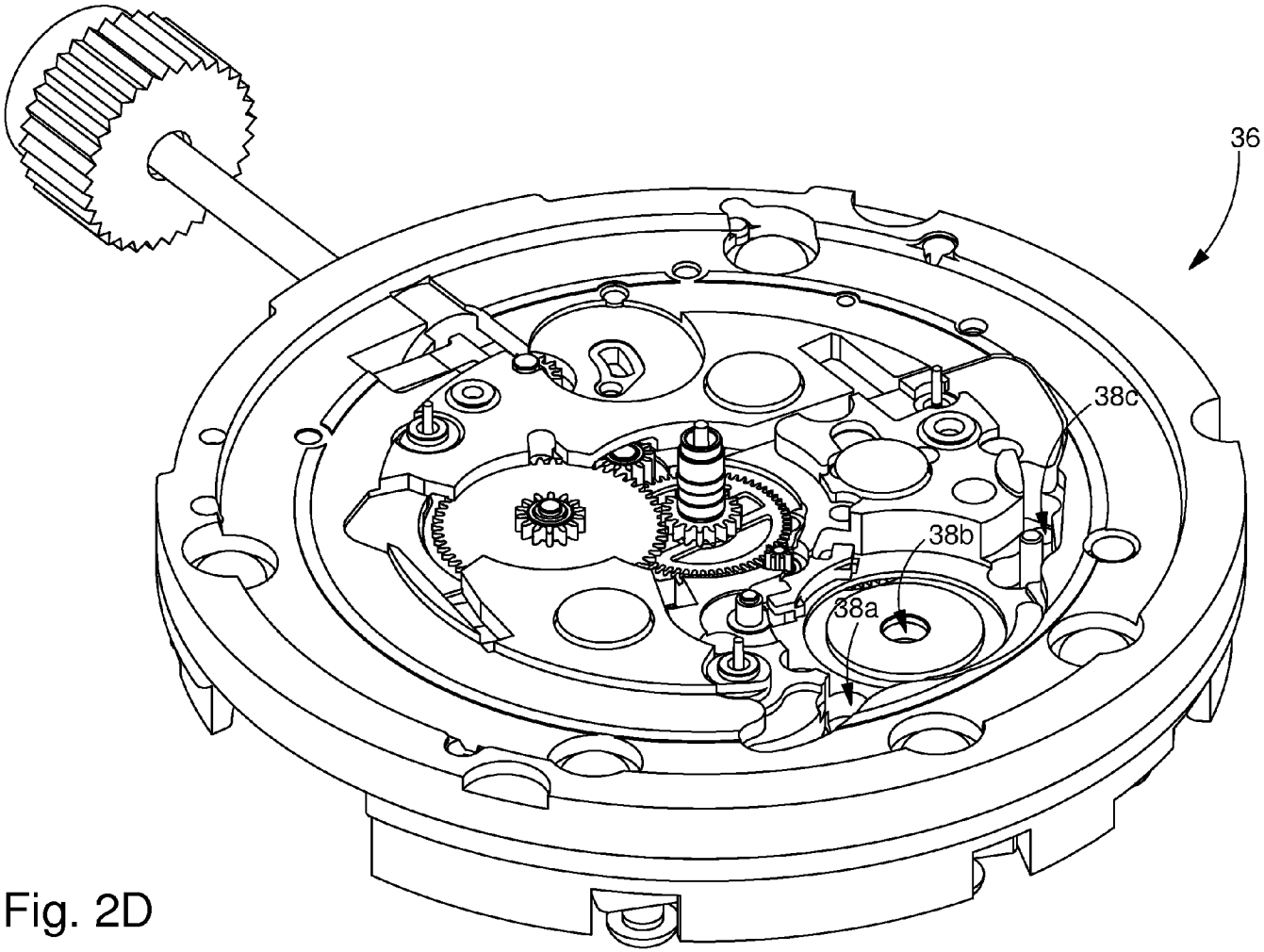
FIG. 2D is a perspective view of a motor module of the electromechanical watch according to the invention.
Figure 2E:
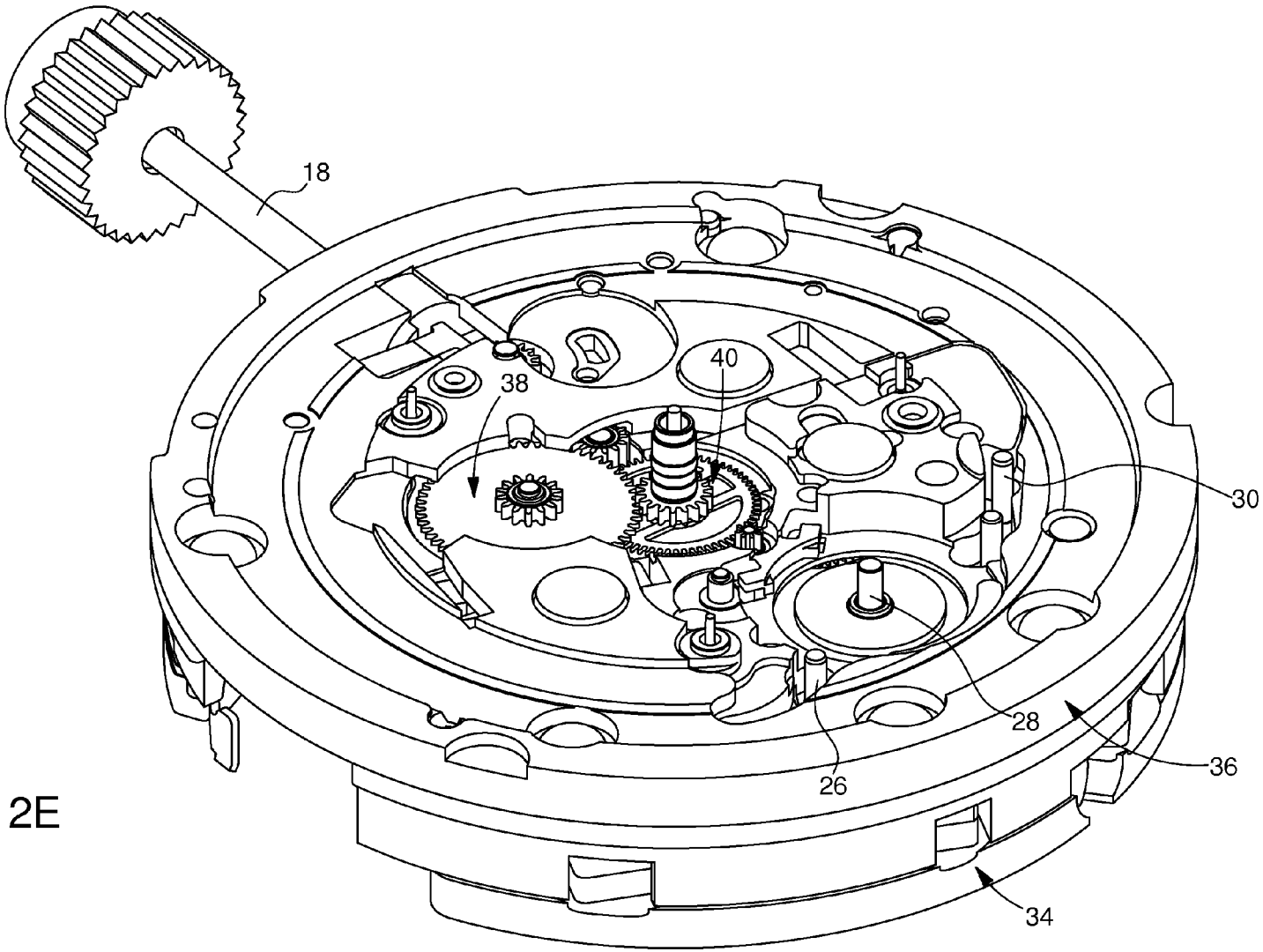
FIG. 2E is a perspective view of the assembled electronic unit illustrated in FIG. 2C assembled with the motor module of FIG. 2D.

FIG. 2A is a perspective view of an electronic module 24 which carries three studs 26, 28 and 30, which stand perpendicularly to the surface of the electronic module 24 and whose roles will be described in detail below. Electronic module 24 is mounted on an additional plate 32 (see FIG. 2B) to form an assembled electronic unit 34 illustrated in FIG. 2C. FIG. 2D is a perspective view of a motor module 36 of electromechanical watch 1 according to the invention, which has, in particular, three apertures 38*a*, 38*b* and 38*c* allowing three studs 26, 28 and 30 of electronic module 24 to pass therethrough, after the assembled electronic unit 34 has been assembled with the motor module 36 of electromechanical watch 1 (see FIG. 2E). Without entering into the design details of motor module 36 of electromechanical watch 1 according to the invention, which is not the subject of this patent application, the presence of a motion work wheel 38, which drives a cannon-pinion 40 placed at the centre of motor module 36, may nonetheless be noted. It is noted that as shown in FIG. 2E, stem 18 is in the pulled out time-setting position T3.

Figure 2F:
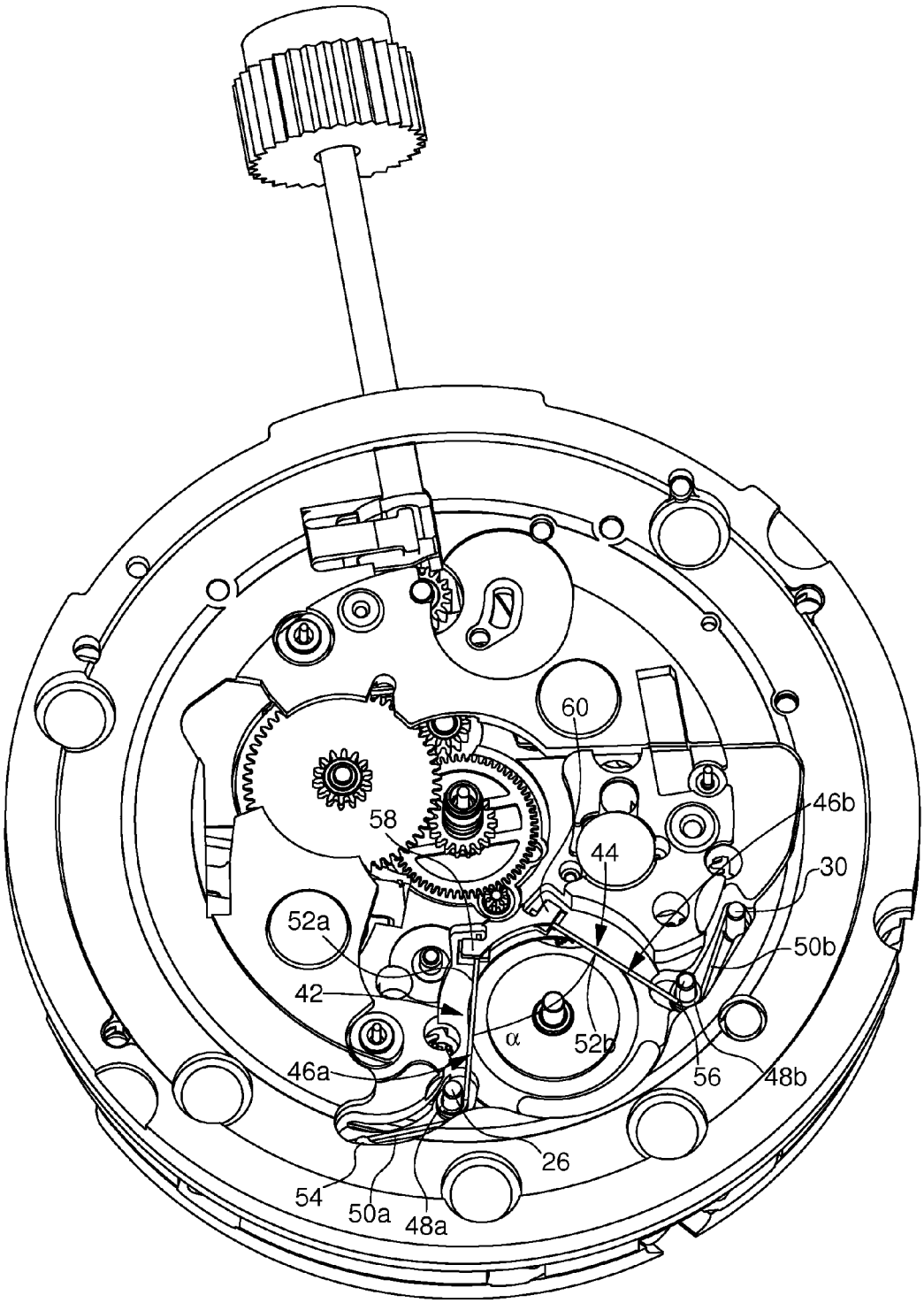
FIG. 2F is a perspective view of the motor module of FIG. 2E including first and second detection means of the device according to the invention.

Reference will now be made to FIG. 2F which shows an alternative embodiment of the first and second detection means of the device according to the invention. According to this embodiment, given purely by way of illustration, each of the first and second detection means, respectively designated by the reference numerals 42 and 44, is formed by a wire spring 46*a*, 46*b* wound around itself in one or several coils 48*a*, 48*b* so as to be able to engage on the corresponding stud 25, 56. It will be noted that stud 56 is a stud made of a non-conductive plastic material which is integral with the plate of motor module 36. Wire springs 46*a*, 46*b* are folded into a substantially V-shape and thus have two arms 50*a*, 52*a* and 50*b*, 52*b* which are symmetrical relative to windings 48*a*, 48*b*.

Figure 2G:
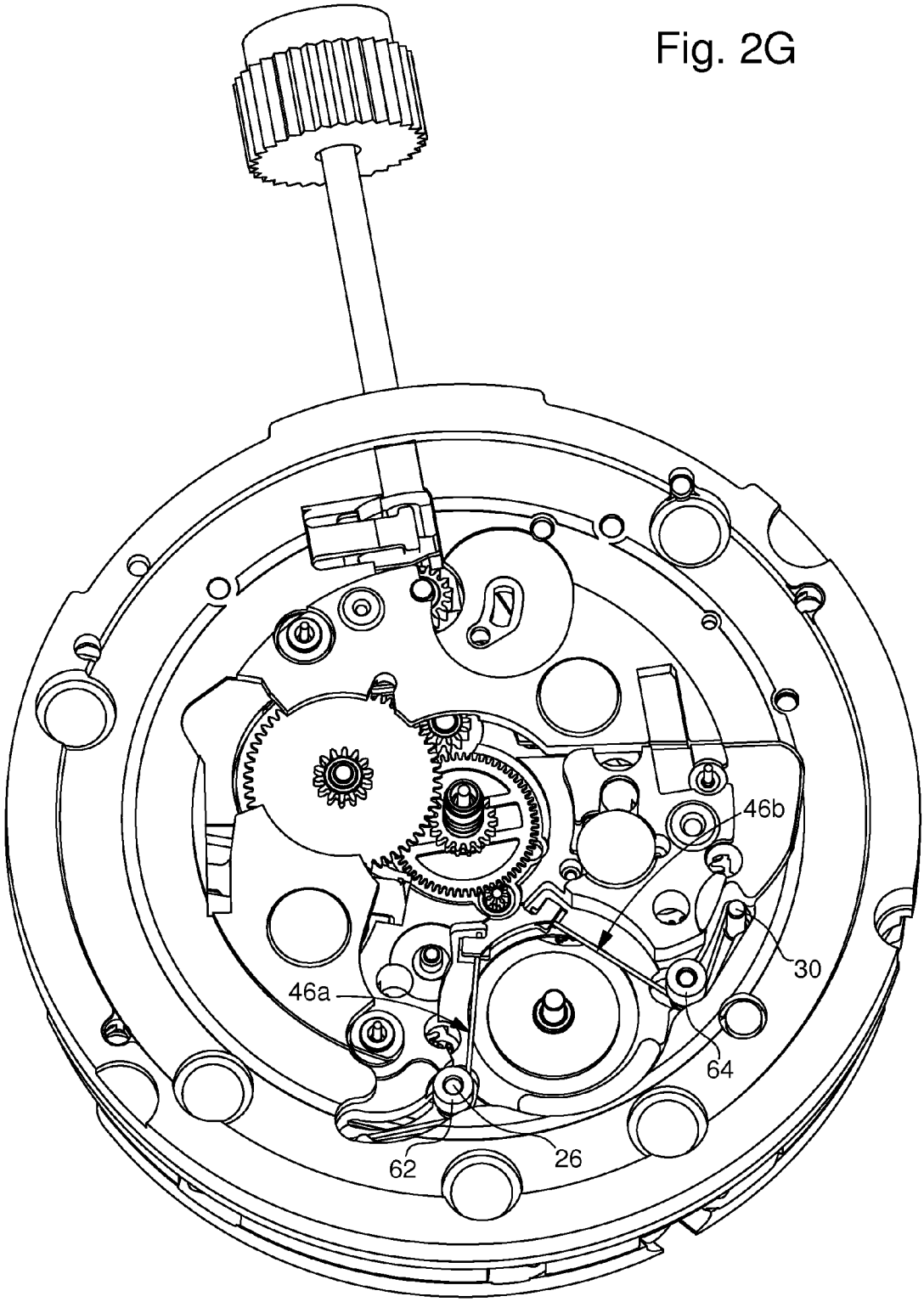
FIG. 2G is a similar view to that of FIG. 2F showing that the wire springs are vertically locked.
Figure 2H:
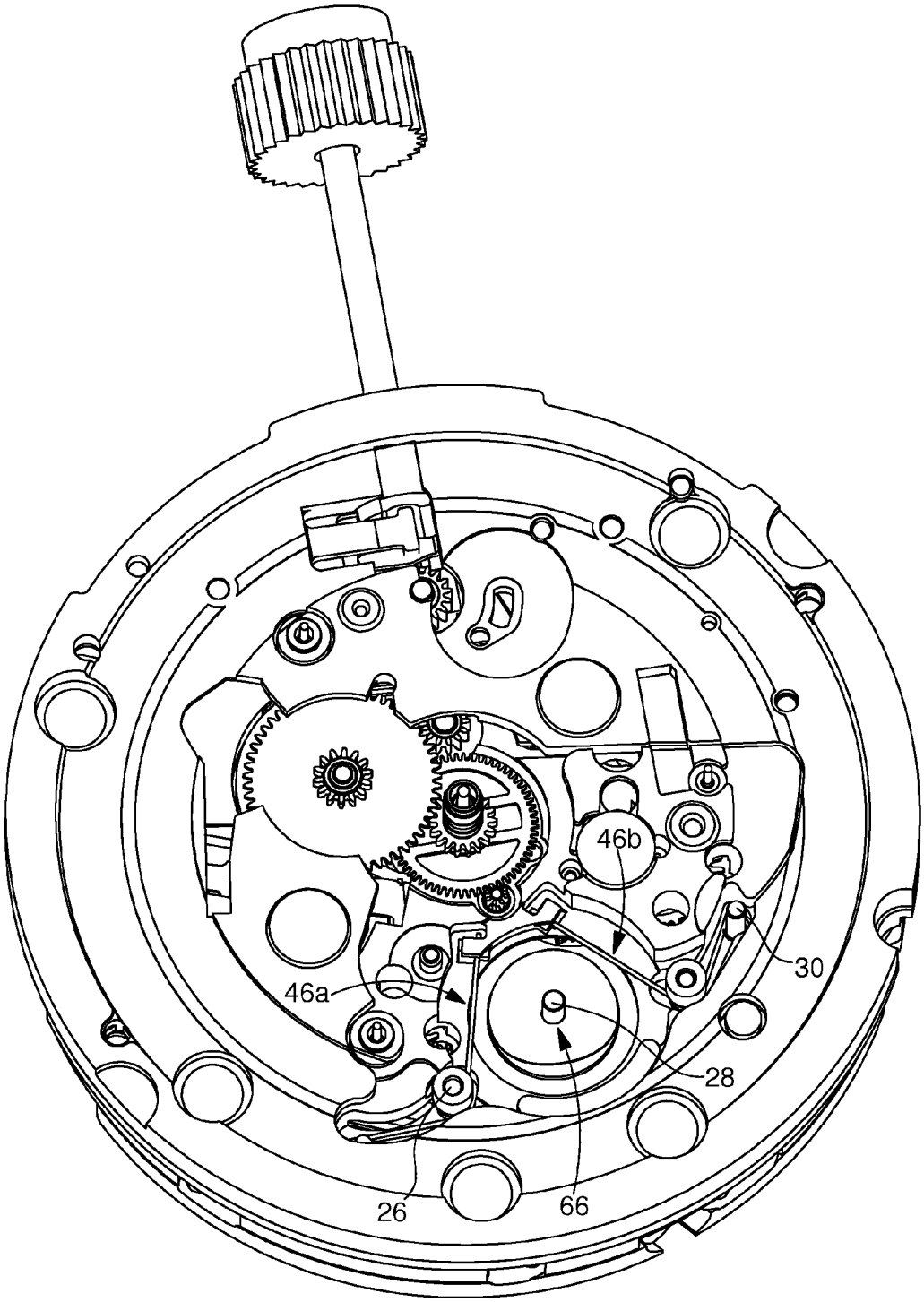
FIG. 2H is a similar view to that of FIG. 2G showing that a washer is engaged on the earthing stud.

As will be seen below, arms 52*a* and 52*b* of the two wire springs 46*a*, 46*b* form electrical contacts by being brought to a floating electrical potential by studs 26 and 30. The position of these contact arms 52*a*, 52*b* is guaranteed by winding and tightening to wire springs 46*a*, 46*b*. Thus, arms 50*a*, 50*b* of the two wire springs 46*a*, 46*b* are stopped, one by a stop member 54 made of a non-conductive plastic material which is integral with the plate of motor module 36 and the other by contact 30, while the other two arms of wire springs 46*a*, 46*b* are slid into slots 58 and 60 so as to form a preferred angle $\alpha$ of 60° between them. Consequently wire spring 46*a* is stopped from pivoting clockwise, while wire spring 46*b* is stopped from pivoting anticlockwise. Finally (see FIG. 2G), wire springs 46*a*, 46*b* are stopped vertically by means of two washers 62 and 64 engaged on studs 26, 56 after wire springs 46*a*, 46*b*. It can also be seen upon examining FIG. 2H that a disc spring or washer 66 is engaged on stud 28.

Figure 2L:
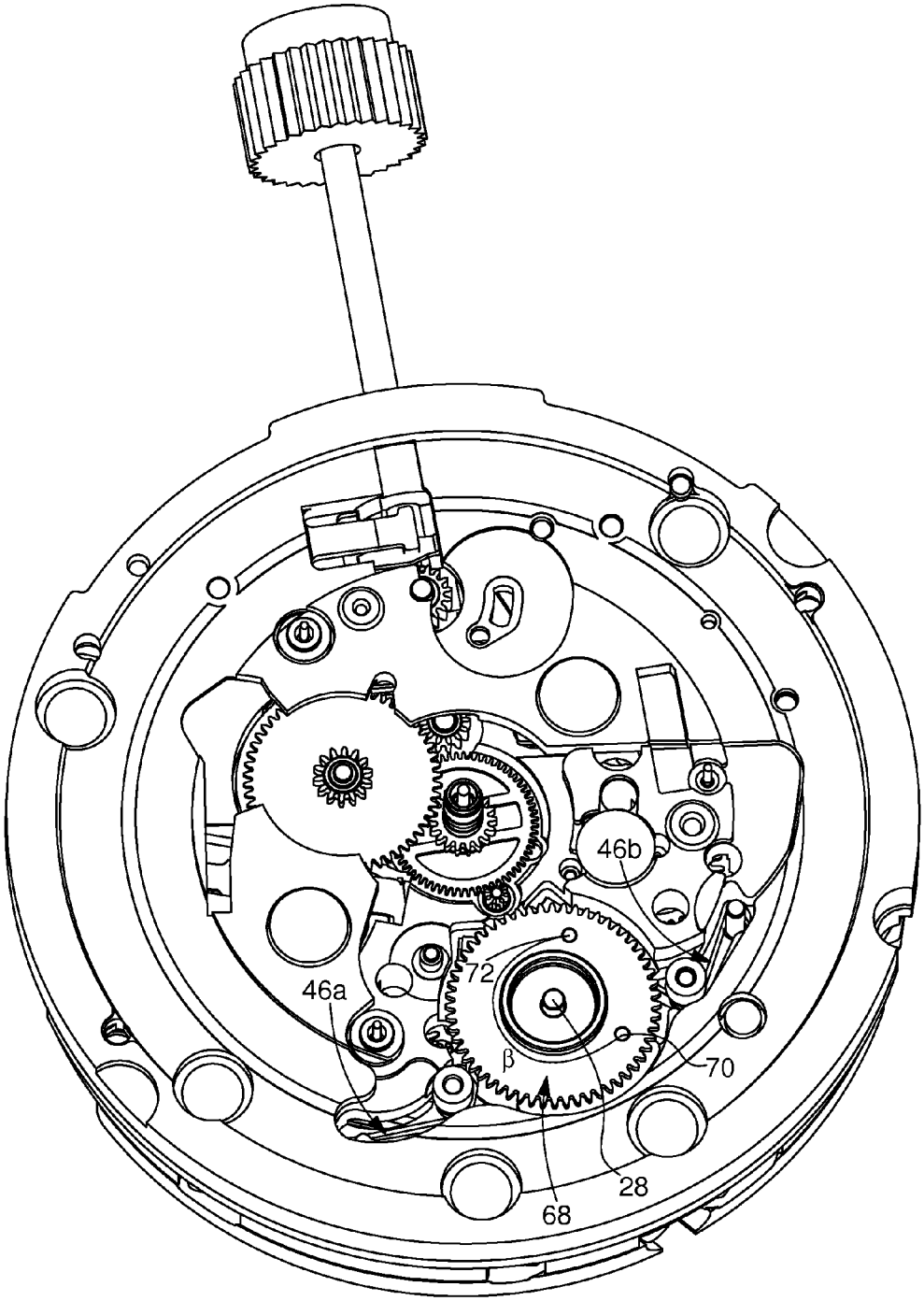
FIG. 2L is a similar view to that of FIG. 2K showing that the entire device is covered by a holding plate.
Figure 2J:
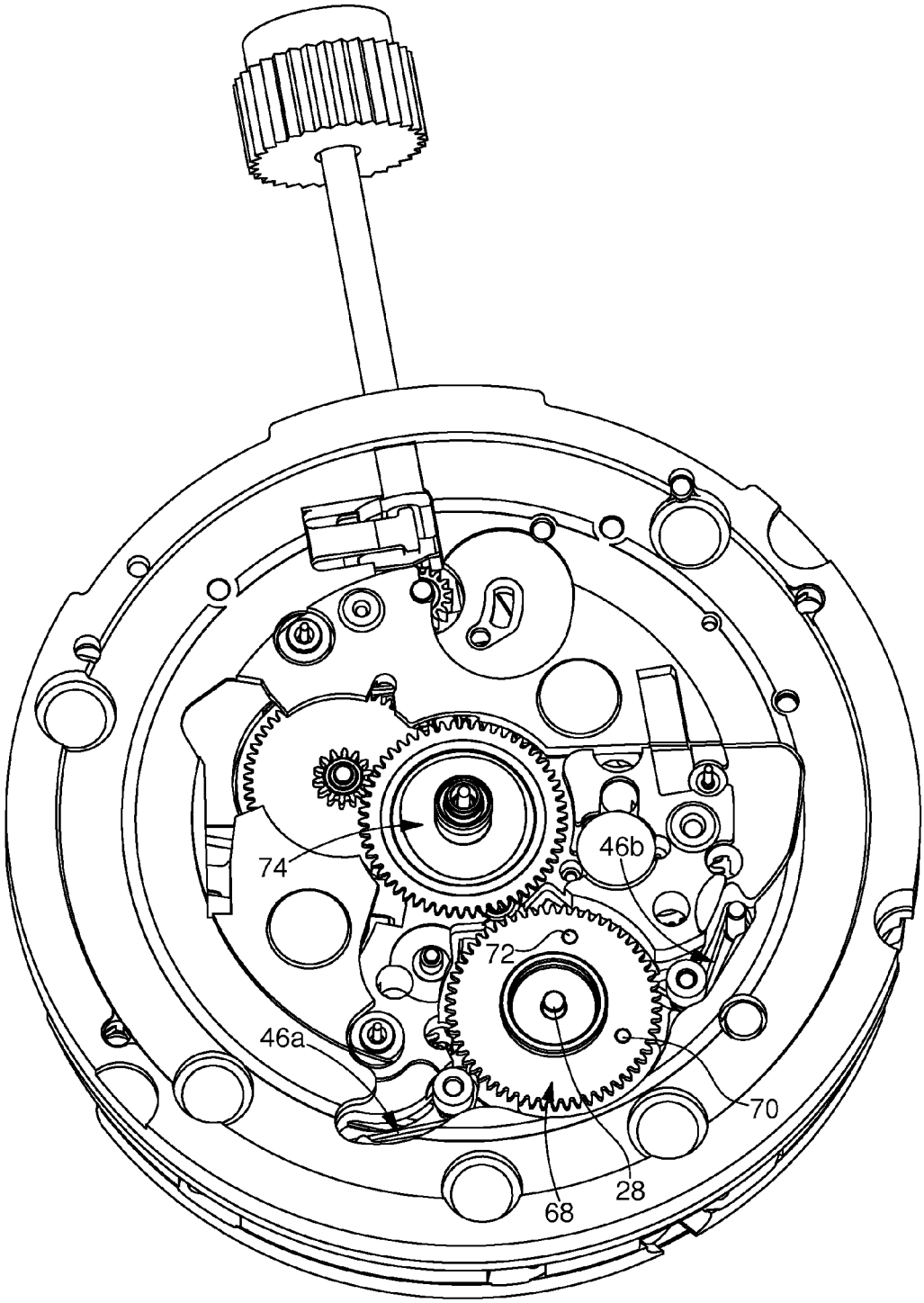
FIG. 2J is a similar view to that of FIG. 2I showing an hour wheel driven by the cannon-pinion of the watch.
Figure 2K:
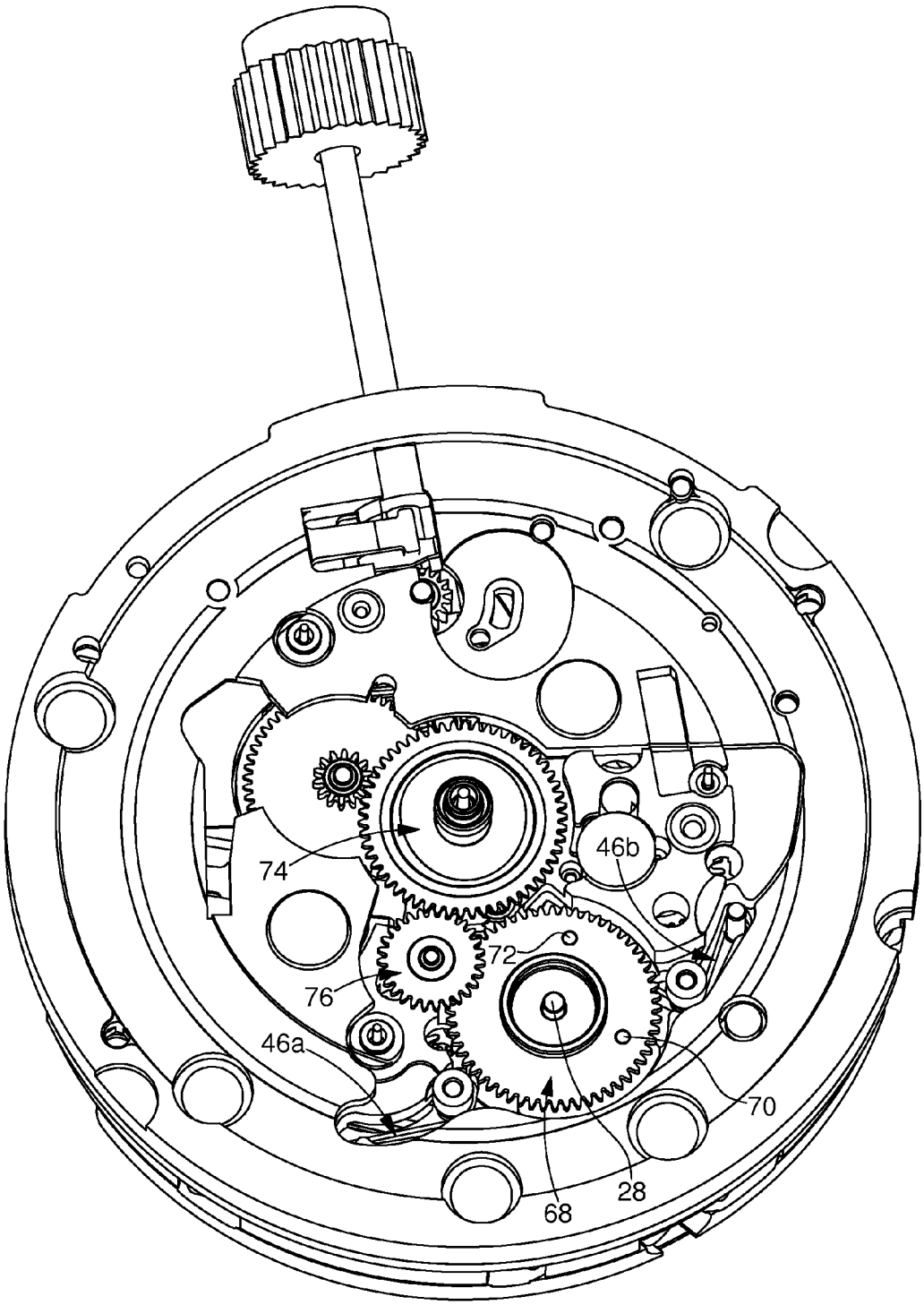
FIG. 2K is a similar view to that of FIG. 2J showing that the actuating wheel is driven at a rate of one complete revolution per twenty-four hours by the hour wheel via an intermediate wheel.
Figure 2L:
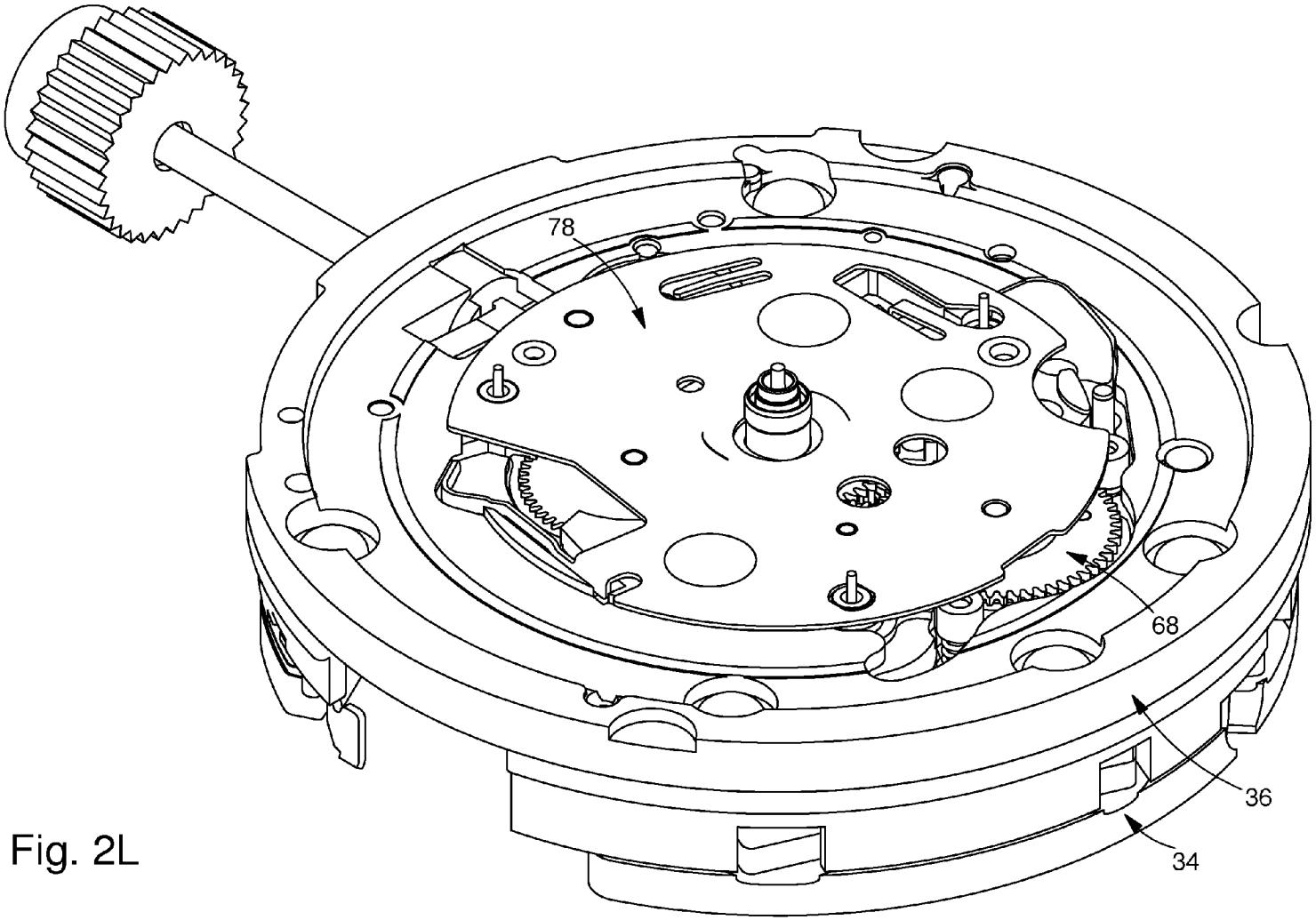

An actuating wheel 68 is engaged on stud 28 after a disc spring 66 (see FIG. 2I). This wheel 68, arranged above wire springs 46*a*, 46*b* is earthed by stud 28. It is fitted with two cylindrical pins 70 and 72 which project underneath the bottom surface thereof and which are arranged to be able to come into contact with the arms 52*a*, 52*b* of wire springs 46*a*, 46*b*. These pins 70, 72 form a preferred angle $\beta$ of 102° between them. The actuating wheel 68 is driven at the rate of one complete revolution per twenty-four hours by an hour wheel 74 (see FIG. 2J) via an intermediate wheel 76 (see FIG. 2K).

The operating principle of the actuation device according to the invention is set out below. Actuating wheel 68, driven by hour wheel 74 via intermediate wheel 76 makes one complete revolution in twenty-four hours. This actuating wheel 68 and thus pins 70 and 72 carried thereby are earthed through stud 28 on which wheel 68 is engaged. The function of the two wire springs 46*a*, 46*b*, located underneath actuating wheel 68, is to pick up electrical signals. When actuating wheel 68 rotates, the pins 70 and 72 carried by said wheel 68 come into contact in sequence with contact arms 52*a*, 52*b* of the two wire springs 46*a*, 46*b* and force the potential of said two springs 46*a*, 46*b* to earth. The electronic control circuit to which the two wire springs 46*a*, 46*b* are connected interprets the signals received from wire springs 46*a*, 46*b* and generates the impulses necessary to operate the motors. More specifically, depending upon whether actuating wheel 68 is rotating clockwise or anticlockwise when the time of electromechanical watch 1 according to the invention is being set or the time zone changed, the order in which pins 70 and 72 touch contact arms 52*a*, 52*b* of the two wire springs 46*a*, 46*b* is reversed, such that the electronic control circuit of watch 1 can deduce, from the order in which contact arms 52*a*, 52*b* are touched by pins 70, 72, the direction (clockwise or anticlockwise) in which actuating wheel 68 and therefore hour wheel 74 is rotating. Further, pins 70, 72 and contact arms 52*a*, 52*b* of the two wire springs 46*a*, 46*b* are arranged such that pins 70, 72 only touch contact arms 52*a* 52*b* simultaneously once per day. As the potential of one of contact arms 52*a*, 52*b* has been forced to earth by one of pins 70 or 72, the electronic control circuit of watch 1 deduces, from the moment at which the potential of the other contact arm is forced to earth by the other pin, the instant when hour wheel 74 changes to midnight. The electronic control circuit of watch 1 therefore knows in which direction hour wheel 74 is rotating and the moment at which the latter changes to midnight, such that it can operate the motors of watch 1 in an appropriate manner to correct the displays.

Finally, the assembled electronic unit 34 and motor module 36 of electromechanical watch 1 are covered by a holding plate 78 (see FIG. 2L) against which the disc spring or washer 66 presses actuating wheel 68 to earth said wheel.

Figure 3A:
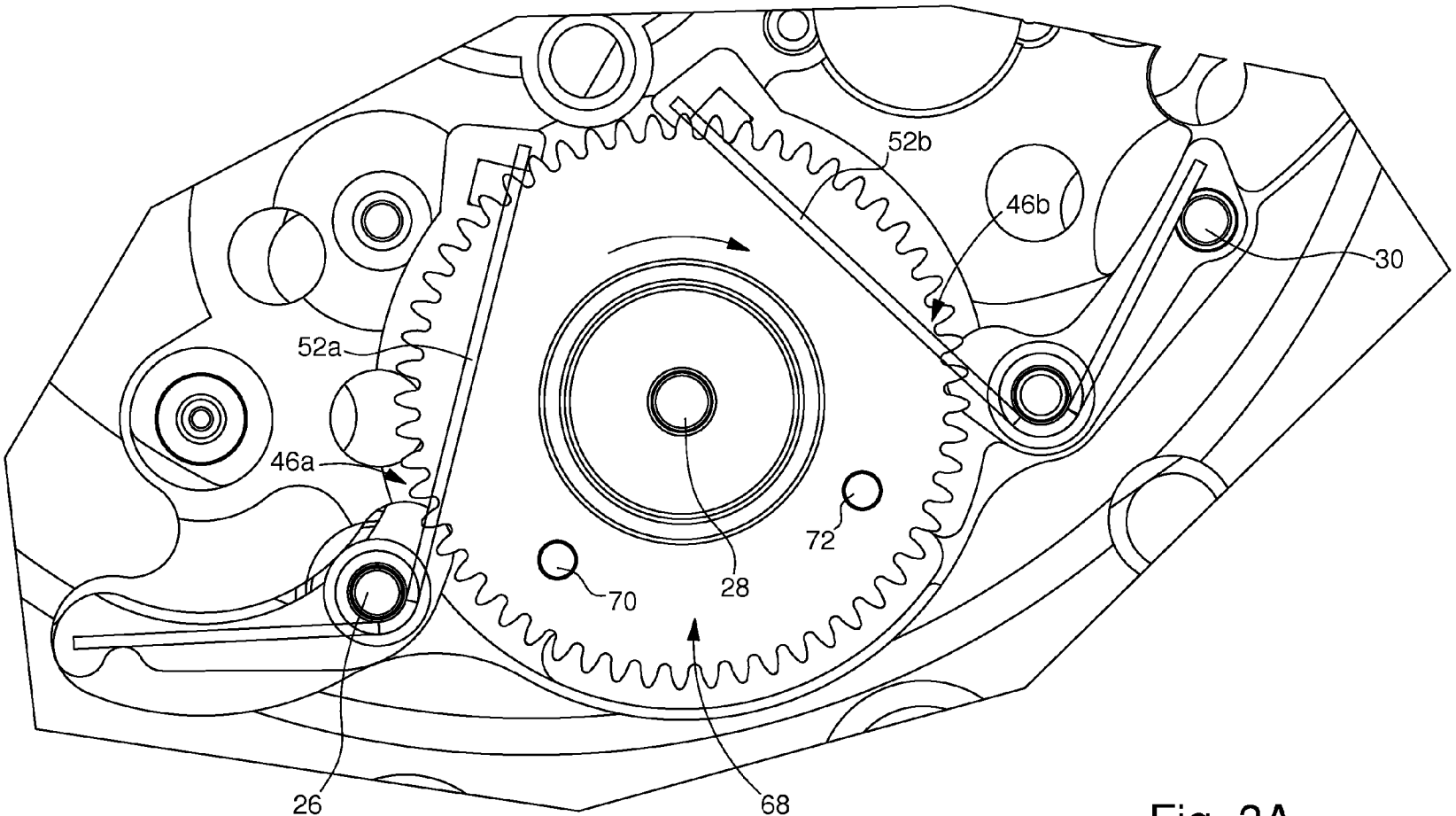
FIGS. 3A to 3H are top views of the detection mechanism according to the invention at different stages in the operation thereof.
Figure 3B:
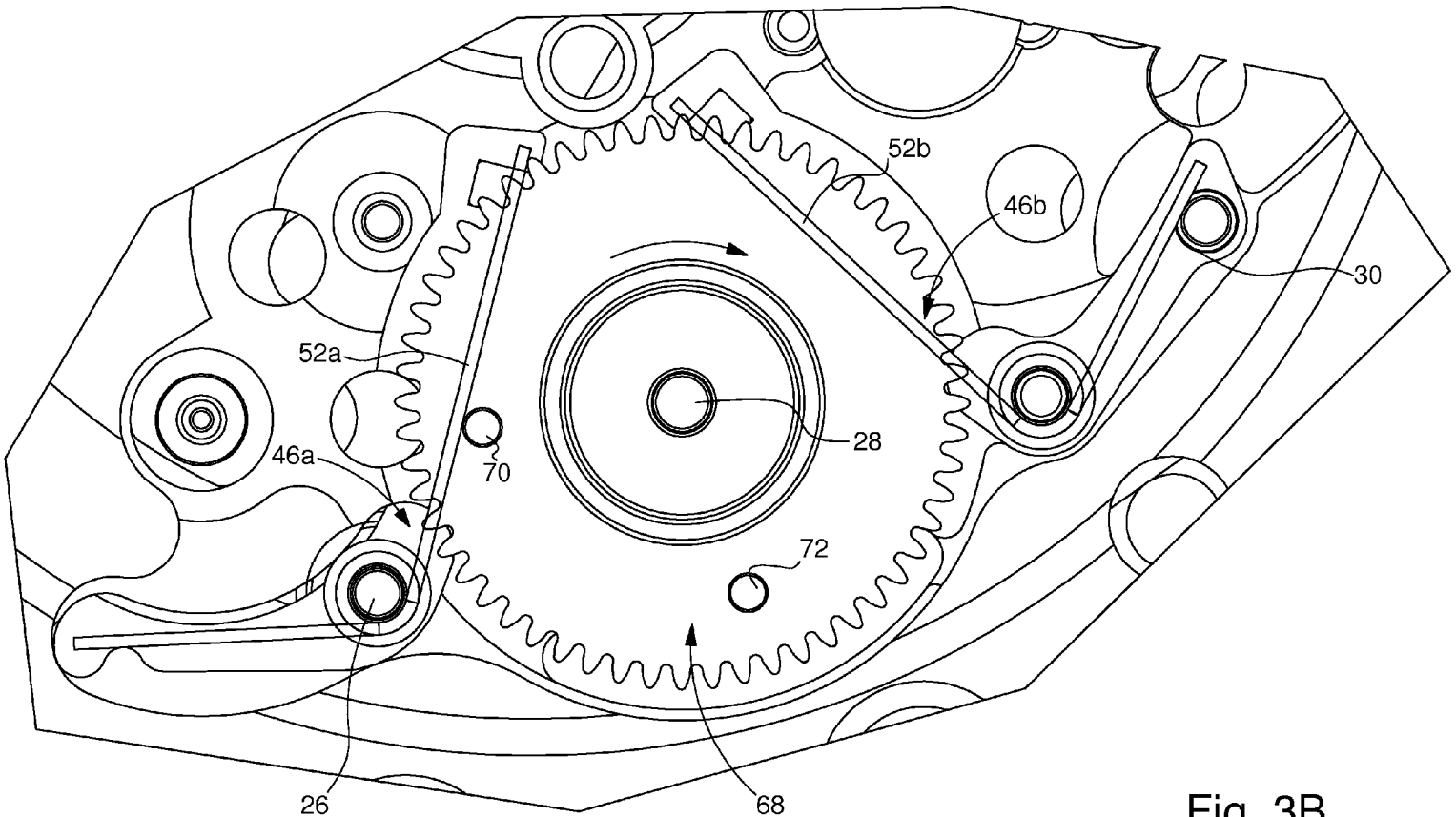
Figure 3C:
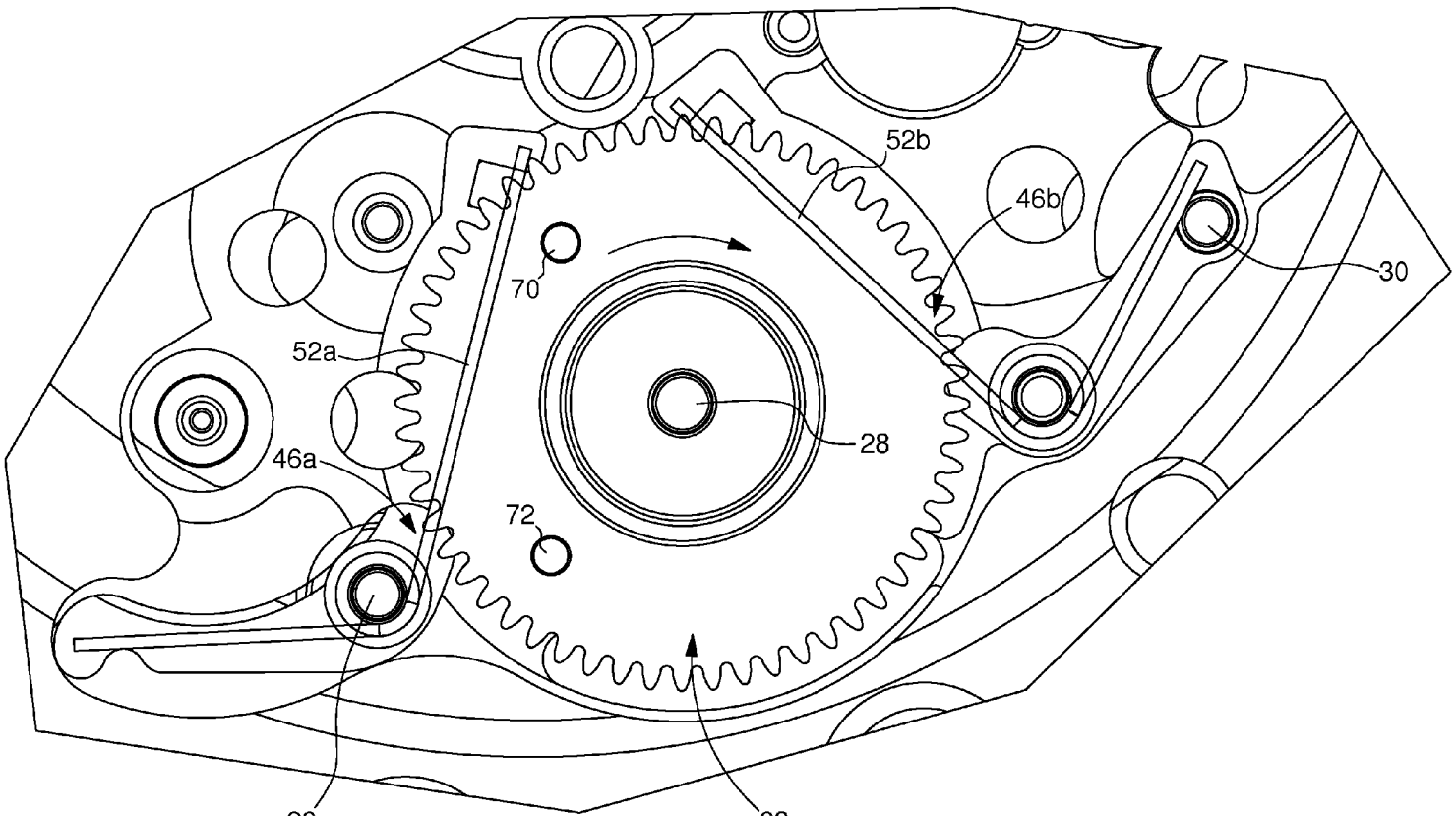
Figure 3D:
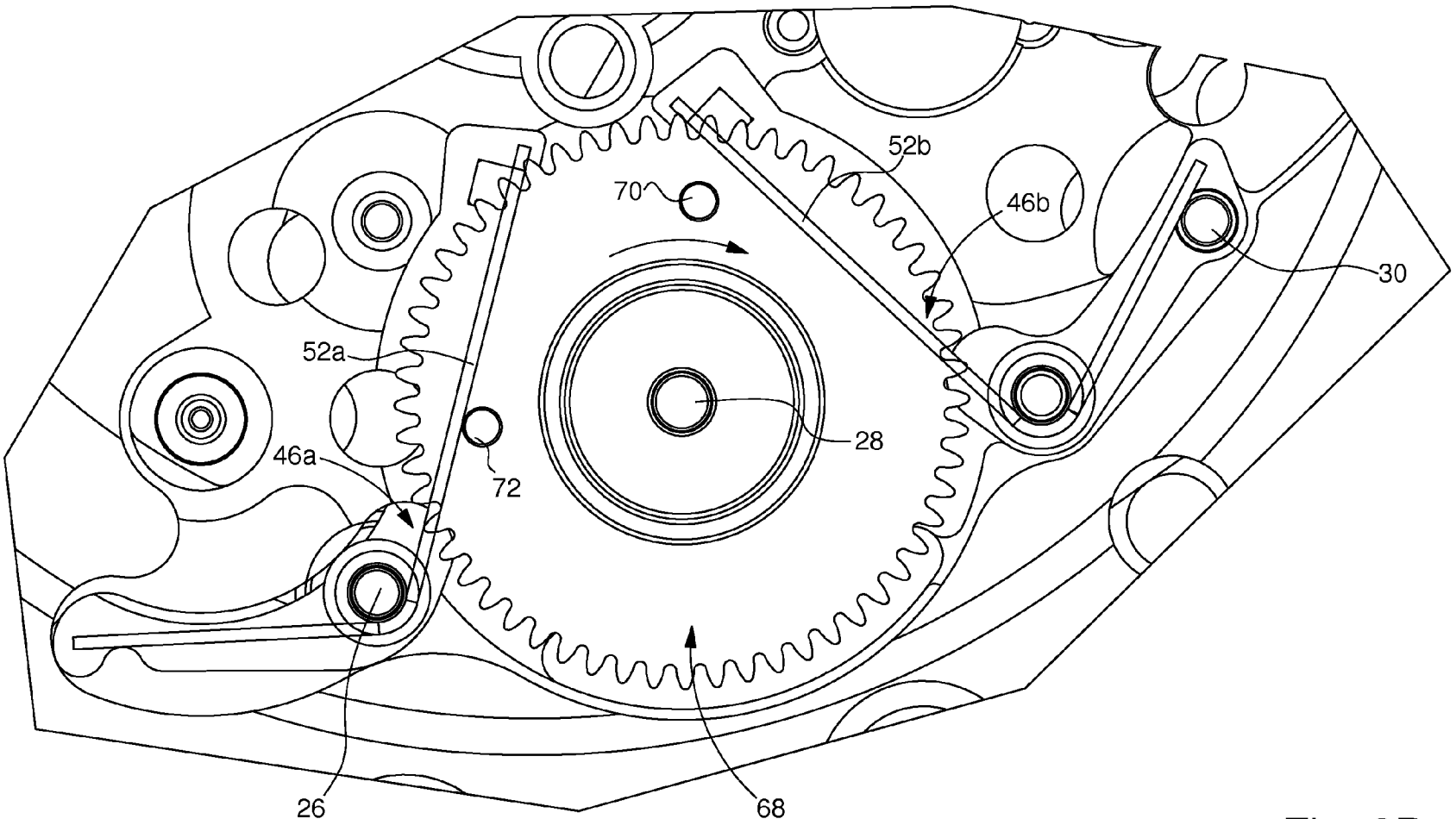
Figure 3E:
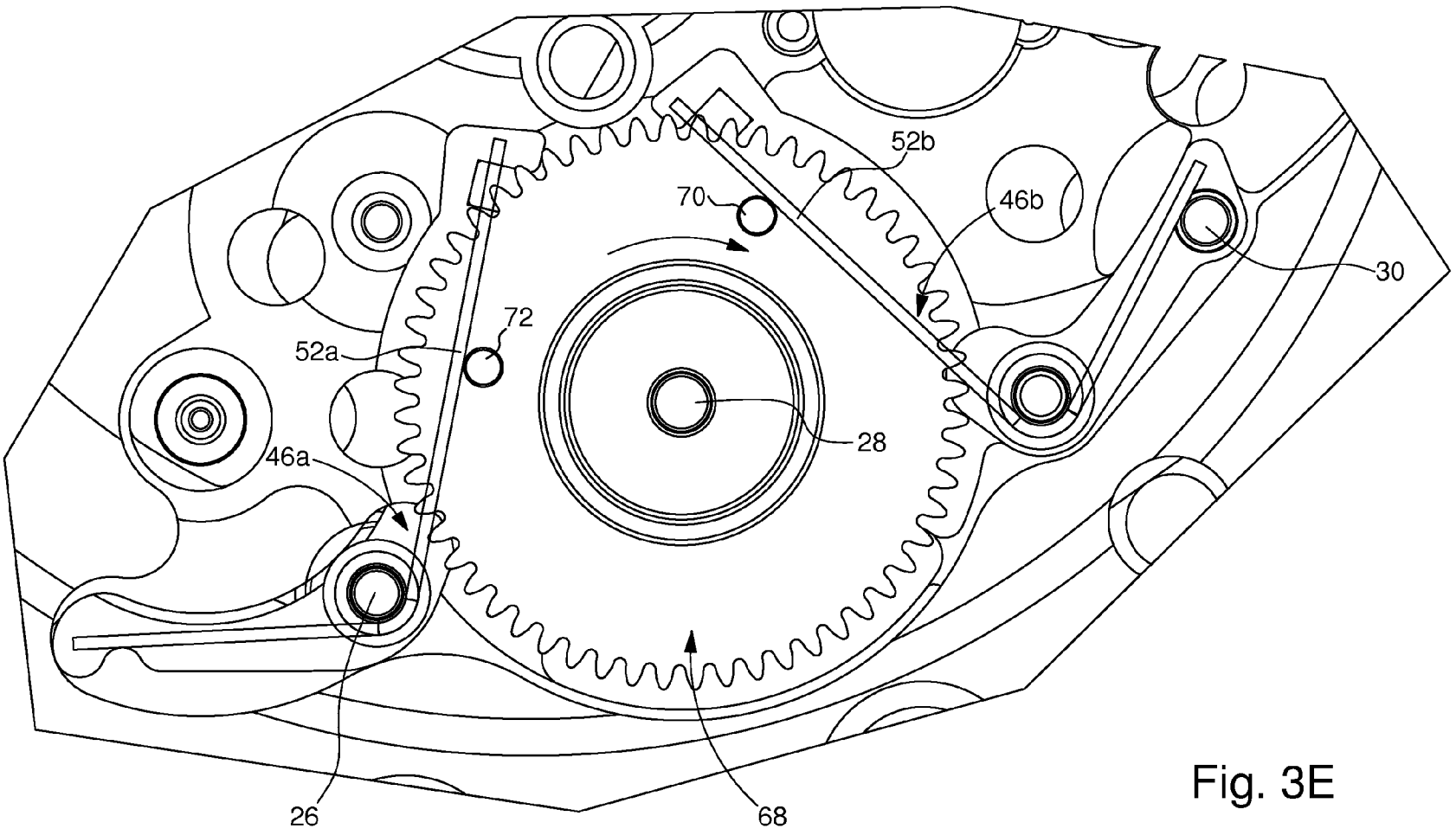
Figure 3F:
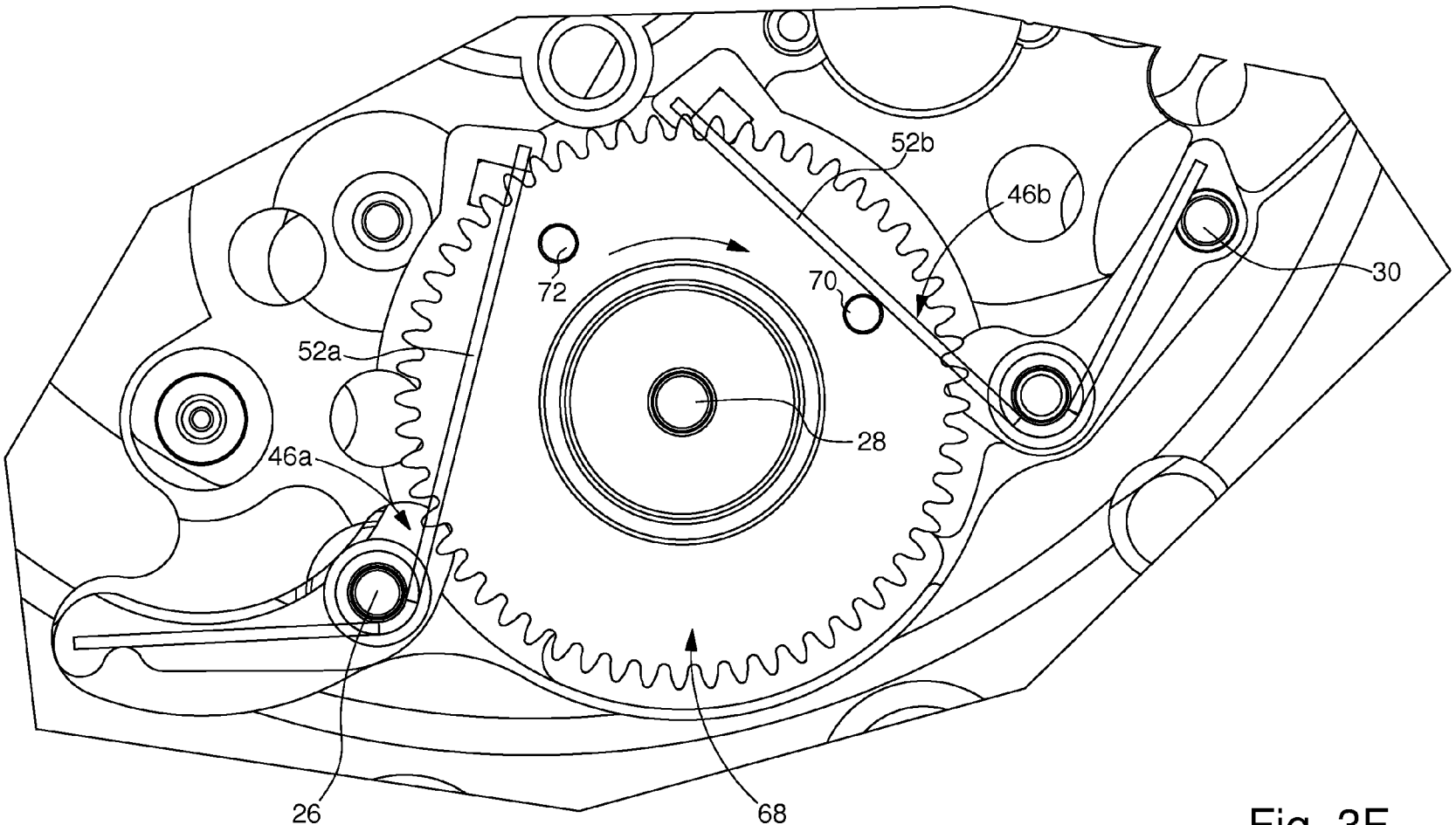
Figure 3G:
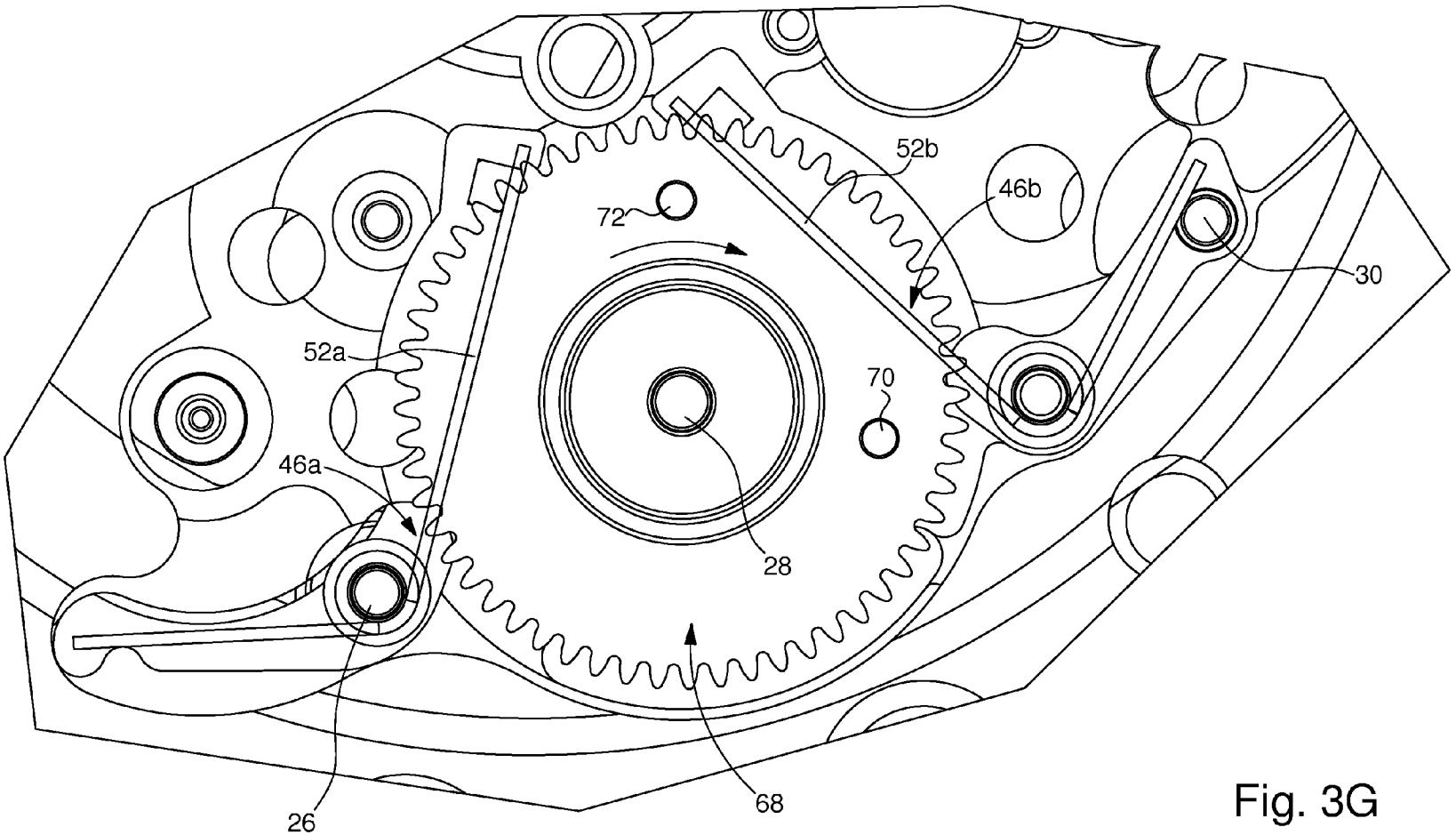
Figure 3H:
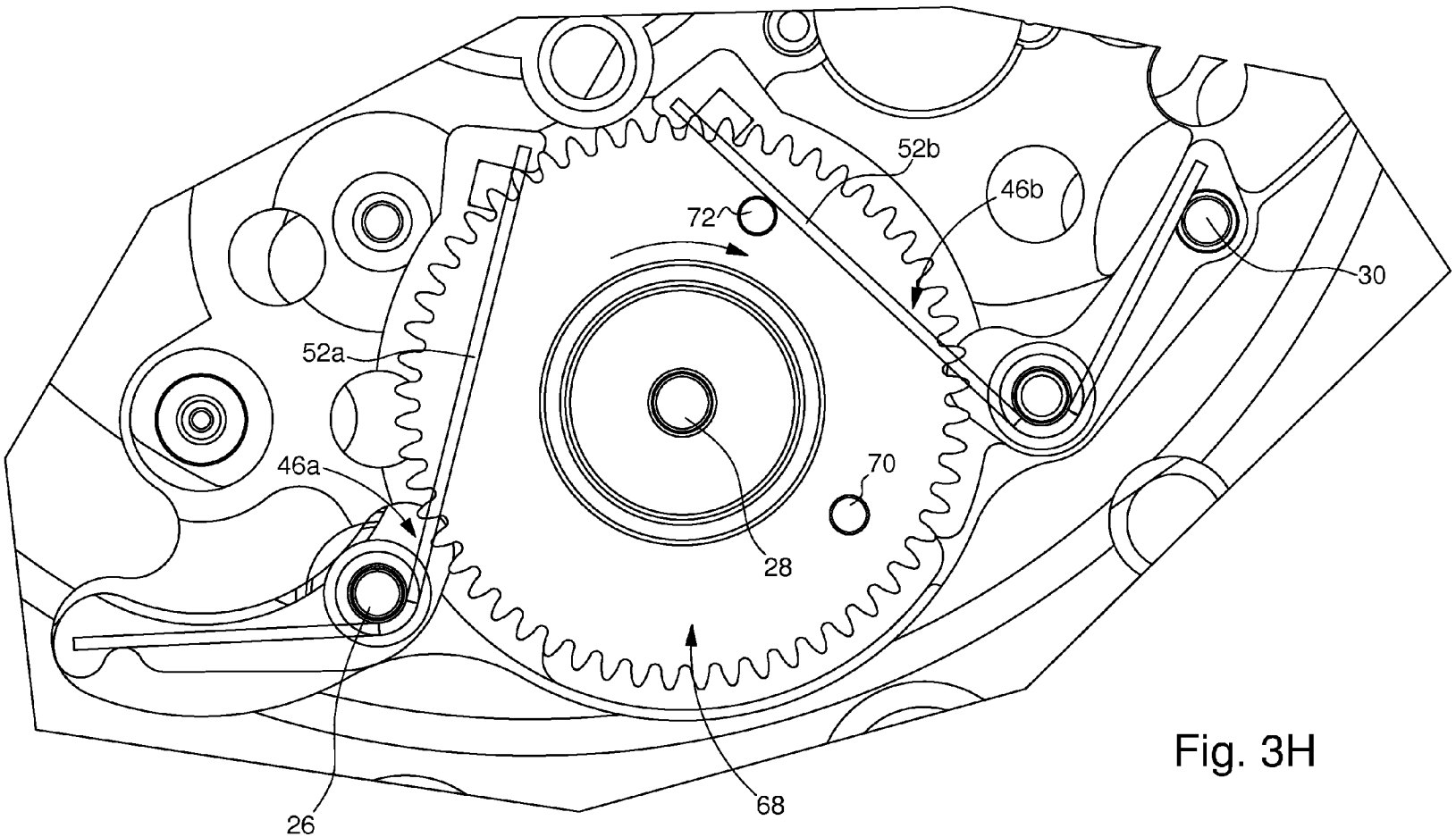
Figure 4:
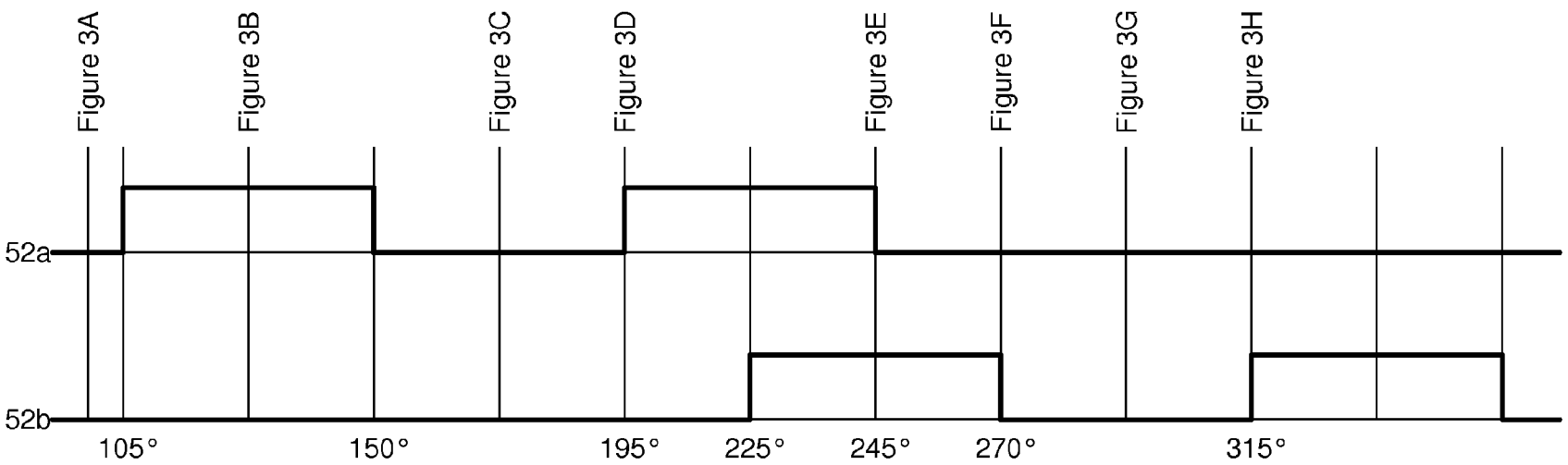
FIG. 4 is a timing diagram showing the evolution of the signals supplied by the first and second detection means as a function of the rotation of the actuating wheel.

An operating sequence of the detection device according to the invention will now be examined in detail with reference to FIGS. 3A to 3H and the timing diagram shown in FIG. 4. It is assumed for the purposes of the description that stem 18, pulled into position T3, is turned manually to set the time or correct the time zone such that actuating wheel 68 is rotating clockwise.

In FIG. 3A it is observed that neither of pins 70, 72 is touching one of contact arms 52*a*, 52*b* of the two wire springs 46*a*, 46*b*. The level of the signals produced by wire springs 46*a*, 46*b* is at "0".

In FIG. 3B, actuating wheel 68 has rotated clockwise and pin 70 has moved to touch contact arm 52*a*, forcing the potential of wire spring 46*a* to earth. The signal produced by wire spring 46*a* and transmitted to the electronic control circuit of watch 1 changes to level "1" while the level of the signal produced by wire spring 46*b* remains at "0".

In FIG. 3C, actuating wheel 68 has continued to rotate. The contact between pin 70 and contact arm 52*a* has been broken, such that the signal produced by wire spring 46*a* drops back to zero. At the same time, the second pin 73 is not touching either of wire springs 46*a*, 46*b*. The signals produced by the two wire springs remain at zero.

In FIG. 3D, actuating wheel 68 has continued to rotate. While pin 70 is not touching either of the two wire springs 46*a*, 46*b*, pin 72 has moved to touch contact arm 52*a*, forcing the potential of wire spring 46*a* to earth. The signal produced by wire spring 46*a* and transmitted to the electronic control circuit of watch 1 changes to level "1" while the level of the signal produced by wire spring 46*b* remains at "0".

In FIG. 3E, actuating wheel 68 has continued to rotate. While pin 72 has remained in contact with contact arm 52*a* of wire spring 46*a* and is thus keeping the potential of wire spring 46*a* at earth, pin 7 has moved to touch contact arm 52*b* of wire spring 46*b* and thus forces the potential of wire spring 46*b* to earth too. The signal produced by wire spring 46*a* and transmitted to the electronic control circuit of watch 1 therefore remains at level "1", whereas the signal produced by wire spring 46*b* changes from "0" to "1". At this precise moment, the signals produced by the two wire springs 46*a* and 46*b* are both at level "1". This situation only occurs once every twenty-four hours and is interpreted by the electronic control circuit of watch 1 as marking the change of time to midnight on the rising edge of the signal produced by wire spring 46*b*. The electronic control circuit of watch 1 is thus able to synchronize all of the motors and operate the forward or backward movement of the indicators affected by the time change or time zone change.

In FIG. 3F, actuating wheel 68 has continued to rotate. The contact between pin 72 and contact arm 52*a* has been broken, such that the signal produced by wire spring 46*a* drops back to zero. At the same time, the first pin 70 is still in contact with wire spring 46*b* whose signal level remains at "1".

In FIG. 3G, actuating wheel 68 has continued to rotate. The contact between pin 70 and contact arm 52*b* has been broken, such that the signal produced by wire spring 46*b* drops back to zero. At the same time, the first pin 70 is not touching either of wire springs 46*a*, 46*b*. The signals produced by the two wire springs 46*a*, 46*b* are therefore at zero.

In FIG. 3H, the actuating wheel has continued to rotate. While the first pin 70 is not touching either of wire springs 46*a*, 46*b*, the second pin 72 has moved to touch contact arm 52*b* of the second wire spring 46, forcing the potential of wire spring 46 to earth. The signal produced by the first wire spring 46*a* remains at zero, whereas the signal produced by the second wire spring 46*b* changes to one.

Beyond this position, the cycle starts again from the beginning as illustrated in FIG. 3A.

The timing diagram shown in FIG. 4 illustrates the potential evolution of the contact arm respectively 52*a*, 62*b* of wire springs 46*a*, 46*b* as a function of the change in position of the first and second pins 70 and 72 as shown in FIGS. 3A to 3H. In other words, the timing diagram of FIG. 4 illustrates the change in potential of studs 26 and 30 and thus the value of the electrical signals applied to the watch control circuit. It will be noted that if one complete 360° rotation of actuating wheel 68 is considered over a twenty-four hour period, the angular range during which the electrical potential of studs 26 and 30 changes is substantially comprised between 105° and 360°. It will also be noted that the angular range during which the electrical potential of one of studs 26 or 30 is at one extends over approximately 45° which corresponds to a duration of three hours.

It will be clear that, depending upon whether actuating wheel 68 is rotating clockwise (as assumed here) or anticlockwise, the order in which the two wire springs 46*a*, 46*b* alternately change from level zero to level one is reversed. The electronic control circuit of watch 1 thus deduces, from the order in which wire springs 46*a*, 46*b* are contacted by pins 70, 72, the direction in which actuating wheel 68 has rotated and thus the direction of time correction or time zone change applied to watch 1. The electronic control circuit of watch 1 is thus able to operate the forward or backward movement of the indicators affected by the time change or time zone change. Moreover, the moment when the potential of one of the wire springs is forced to earth while the other wire spring is already at earth marks the change of the watch display through midnight, which enables the control circuit to synchronize the jumps of all of the motors of watch 1.

It will be noted that the system that has just been described has very little interference or rebounds even after reliability testing. Moreover, as the wire springs are positioned and prestressed, the manufacturing tolerances of these components do not affect the precision of the contact between the pins and the wires springs.

What is claimed is:

1. A device in an electromechanical watch including a watch movement having an electronic control circuit, the device being configured to allow the electronic control circuit of the watch movement to determine the moment at which and the direction in which an indication showing a time related parameter has to be corrected, said device comprising:

an actuating wheel which is driven by the watch movement;

first and second detection means electrically connected to the electronic control circuit, said first and second detection means including first and second wire springs, respectively;

actuating means for actuating the first and second detection means, said actuating means including first and second pins extending from the actuating wheel and rotating therewith, said electronic control circuit deducing, from the moment at which and the order in which the first and second wire springs are actuated by the first and second pins, the direction in which the actuating wheel is being driven by the movement and the moment when the time related parameter has to be respectively incremented or decremented;

wherein the first and second pins project from underneath a bottom surface of the actuating wheel.

2. The device according to claim 1, wherein the actuating wheel which carries the actuating means for the first and second detection means is earthed, whereas the first and second detection means are brought to a floating electrical potential.

3. The device according to claim 2, wherein the actuating wheel makes one complete revolution in twenty-four hours.

4. The device according to claim 3, wherein the first and second wire springs are arranged such that the order in which they are actuated by the actuating means for the actuating wheel driven by the watch movement is reversed depending upon whether the actuating wheel is rotating in the clockwise or anticlockwise direction.

5. The device according to claim 3, wherein the actuating wheel is driven by an hour wheel via an intermediate wheel.

6. The device according to claim 3, wherein once every twenty-four hours and for a determined period of time, the first and second wire springs are actuated simultaneously by the first and second pins carried by the wheel driven by the watch movement.

7. The device according to claim 2, wherein the first and second detection means are wound and tightened.

8. The device according to claim 7, wherein the first and second wire springs are V-shaped with first and second symmetrical arms.

9. The device according to claim 8, wherein the second arm of the first wire spring and the second arm of the second wire spring form an angle of 60° between them.

10. The device according to claim 7, wherein the first wire spring is carried by a first stud which has a floating electrical potential, and in that the second wire spring is carried by a second stud which does not conduct electricity, the second wire spring touching a third stud, which is brought to a floating electrical potential.

11. The device according to claim 2, wherein the first and second wire springs are V-shaped with first and second symmetrical arms.

12. The device according to claim 11, wherein the second arm of the first wire spring and the second arm of the second wire spring form an angle of 60° between them.

13. The device according to claim 2, wherein actuating wheel is carried by a stud which is connected to earth.

14. The device according to claim 13, wherein the actuating means carried by the actuating wheel are formed by first and second pins which project underneath the bottom surface of the actuating wheel.

15. The device according to claim 14, wherein the first and second pins carried by the actuating wheel form an angle of 102° therebetween in relation to a center of the actuating wheel.

16. The device according to claims 15, wherein, considering the watch from the bottom upwards, the actuating wheel is arranged above the first and second wire springs.

17. The device according to claims 14, wherein, considering the watch from the bottom upwards, the actuating wheel is arranged above the first and second wire springs.

* * * * *